United States Patent [19]

Glanvall

[11] Patent Number: 4,737,082

[45] Date of Patent: Apr. 12, 1988

[54] LIFT VALVE FOR ROTARY SCREW COMPRESSORS

[75] Inventor: Rune V. Glanvall, Norrköping, Sweden

[73] Assignee: Stal Refrigeration AB, Norrköping, Sweden

[21] Appl. No.: 7,619

[22] Filed: Jan. 28, 1987

[30] Foreign Application Priority Data

Jan. 31, 1986 [SE] Sweden ..... 8600427

[51] Int. Cl.[4] ..... F01C 1/16; F04B 49/00

[52] U.S. Cl. ..... 417/310; 418/159

[58] Field of Search ..... 251/63, 63.4; 417/310; 418/201, 159, 180

[56] References Cited

U.S. PATENT DOCUMENTS 1,153,973 9/1915 Tacit et al. ..... 251/63
4,112,766 9/1978 Ragains ..... 251/63
4,133,510 1/1979 Lorimor ..... 137/625.66
4,238,112 12/1980 Derozier ..... 137/625.66
4,257,442 3/1981 Claycomb ..... 251/63

FOREIGN PATENT DOCUMENTS 131791 7/1984 Japan ..... 417/310

*Primary Examiner*—William L. Freeh
*Attorney, Agent, or Firm*—Watson, Cole, Grindle & Watson

[57] ABSTRACT

When regulating the capacity of a rotary screw compressor in a refrigeration and heating pump system and when varying the built-in volume therein, lift valves are used which operate instantaneously and are either open or closed. In order to ensure sufficient pressure on the lift valves to effect closing, the wall of the lift valves is shaped with two different diameters and a sharply defined step therebetween. Upon closing, the sharply defined step is influenced by a pressure which is lower than the pressure influencing the end surfaces of the lift valve.

6 Claims, 4 Drawing Sheets

LIFT VALVE FOR ROTARY SCREW COMPRESSORS

FIELD OF THE INVENTION

The present invention relates to a lift valve for a rotary screw compressor in refrigeration and heating pump systems, by which the capacity of the rotary screw compressor can be regulated and its built-in volume varied.

BACKGROUND OF THE INVENTION

The capacity of a rotary screw compressor in refrigeration and heating pump systems is usually controlled by one or more axially displaceable sliding valves, for instance of the SRM type, see FIG. 1 of the accompanying drawings. If a controllable slide stop is added, the built-in volume can also be varied.

A regulating principle which is used less seldom is one in which lift valves regulate the capacity of the rotary screw compressor and vary the built-in volume. These valves operate instantaneously and are either open or closed. When they close towards the operating chamber, the valves are subjected to the pressure in the operating chamber which, due to pulsations, pressure drops, and so on, may be higher than the outlet pressure of the compressor, and is higher than this pressure at the outlet. The inwardly directed pressure on the valves must therefore be greater than that directed outwardly from the operating chamber, in order to ensure that the valves are closed and to prevent them operating unsteadily (chattering).

A simple construction of the lift valve is particularly attractive in the case of small compressors which, for commercial reasons must be inexpensive and simple in function. These compressors thus often lack an oil pump or other means of increasing pressure and the outlet pressure of the compressor is the highest pressure in the system, even outside the operating chamber of the compressor. It is thus this highest system pressure which is to control the movement of the lift valves.

SUMMARY OF THE INVENTION

In order to ensure that the pressure on the lift valves for regulating the capacity of a rotary screw compressor and for varying its built-in volume is sufficiently great to ensure that the openings in the cylindrical walls of the compressor are closed by the valves, the lift valves are designed stepwise having two different diameters with a surface between the steps. When the valves close, this surface is influenced by a pressure which is lower than the pressure influencing the end surfaces of the lift valves. The total closing pressure on the valve will therefore be sufficient.

DESCRIPTION OF THE PREFERRED EMBODIMENT

Figure 1:
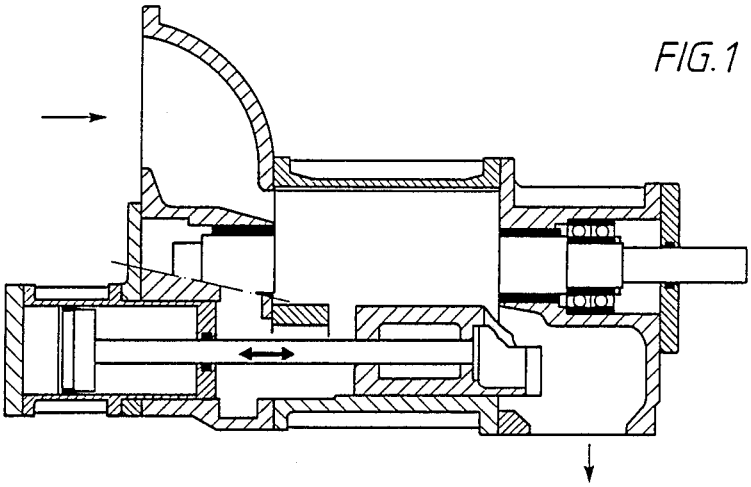
FIG. 1 shows a section through a rotary screw compressor with sliding valve.
Figure 2:
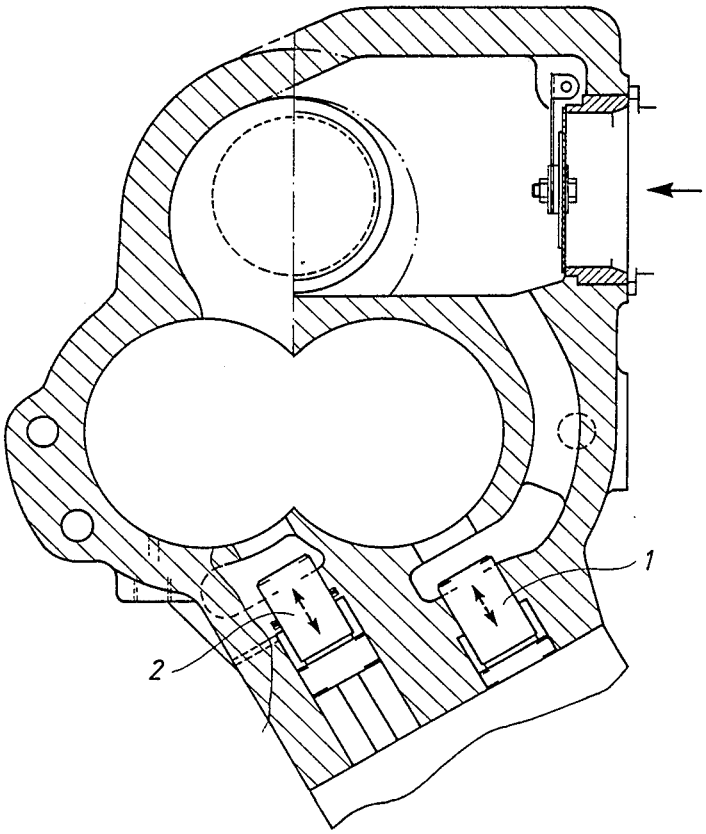
FIG. 2 shows a cross section through a rotary screw compressor which includes lift valves according to a first preferred embodiment of the present invention.
Figure 3:
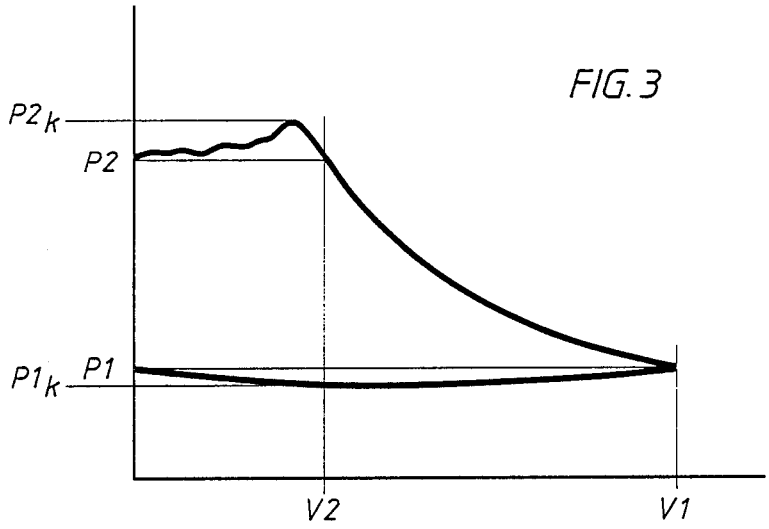
FIG. 3 shows the ratio between pressure P and volume V, in the rotary screw compressor shown in FIG. 2.

A PV diagram in which the compressor is operating optimally according to $$P2/P1=(V1/V2)^n$$

is shown in FIG. 3.

In this optimal case it can be seen that pressure drops at gates cause the internal pressure of the compressor, $P1_k$, $P2_k$, to differ from the pressure of the system, P1 and P2, respectively. P1 and $P1_k$ represent the external and internal pressures pertaining to the lift valve for capacity regulation. P2 and $P2_k$ represent the external and internal pressures pertaining to the lift valve for regulating the outlet (built-in volume).

With fluctuations in the pressure ratio of the system, which are the rule rather than the exception, the difference $P2_k-P2$ will be large and it is always $P2_k$ which tends to open the lift valve to regulate the built-in volume. The lift valves for capacity regulation are in the area V1−V2, theoretically safely below P2. However, local pressure fluctuations in the operating chamber of the compressor may reduce this margin to a critical level, particularly in the case of lift valves near the outlet plane.

Figure 5:
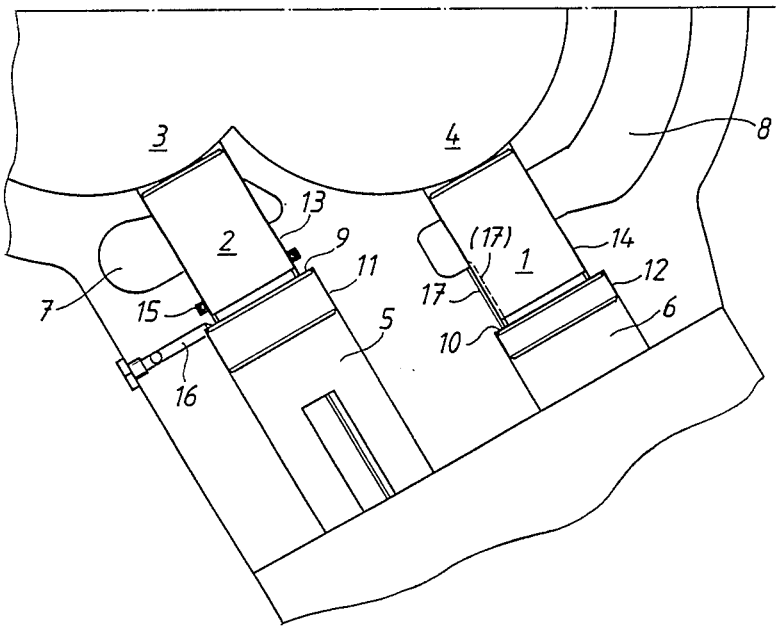
FIG. 5 shows a similar view to FIG. 4 but wherein the lift valves are in a different operating position.
Figure 4:
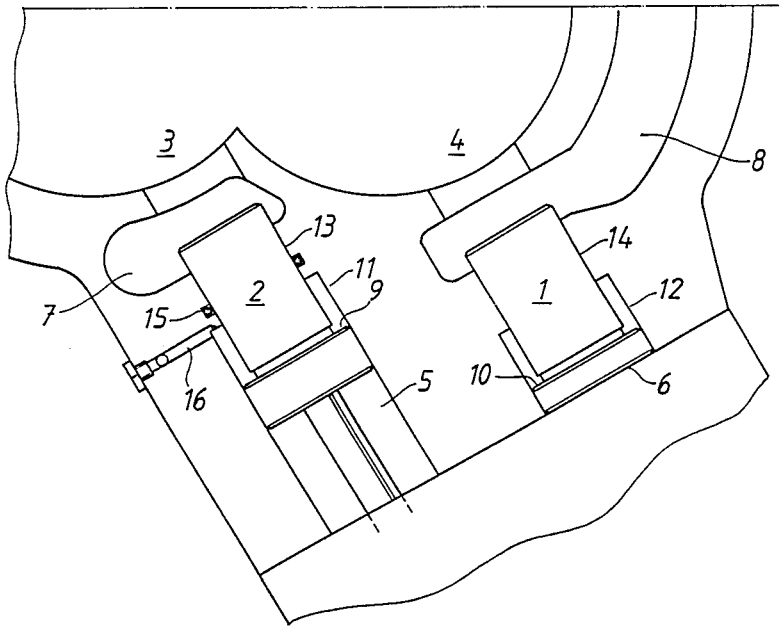
FIG. 4 shows, on an enlarged scale, a detail of the rotary screw compressor shown in FIG. 2.
Figure 6:
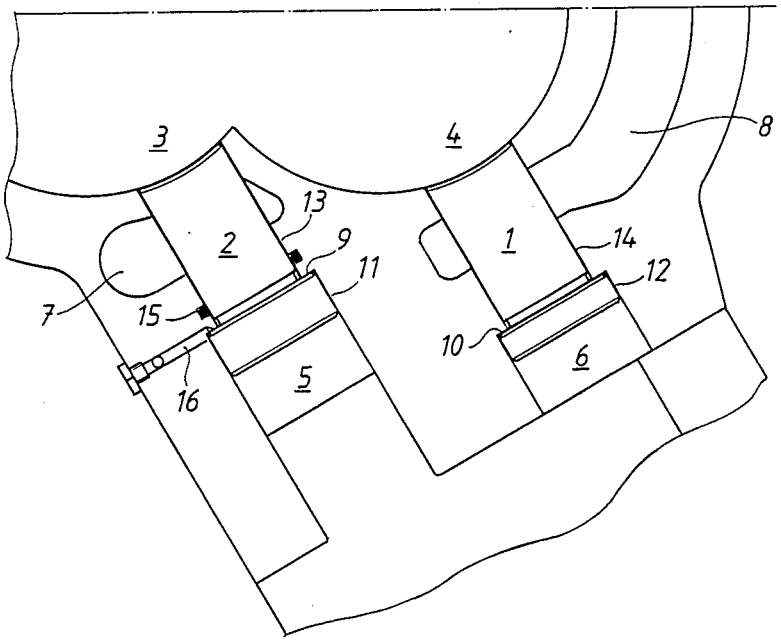
FIG. 6 shows a similar view to FIG. 4 of a rotary screw compressor which includes lift valves according to a second preferred embodiment of the present invention.

FIGS. 4 to 6 show a rotary screw compressor with two cooperating rotors. Lift valves for capacity regulation 1 and for outlet (built-in volume) regulation 2 are provided in respective cylindrical walls of the compressor. FIG. 4 shows the valves closed, where the internal pressure $P2_k$ of the compressor acts at 3 and a lower, intermediate pressure acts at 4. In order to counteract corresponding forces on the lift valves, these are subjected at their outer end surfaces to the system pressure P2 which in practice, however, is somewhat lower than $P2_k$ due to pressure drop and leakage. The system pressure P2 prevails around the lift valve 2 at its inner end. The system's lowest pressure, corresponding to suction in the compressor, usually prevails around the lift valve 1, at its inner end at channel 8.

To ensure that the force as a function of the pressure at 5 or 6, respectively, is greater than the force as a function of the pressure at 3 and 4, respectively, the cylindrical wall of each valve 1, 2 is shaped having diameters different from each other. The pressure required on the sharply defined step therebetween, constituting an axially directed surface at 9 and 10, respectively, must thus be less than the system pressure P2. This can apparently be fulfilled for the piston 1 (regulating capacity) provided the leakage of pressure medium at 6 through gap 12 is less than the leakage through gap 14. However, this is strongly dependent on tolerances and gap areas. For lift valve 2, the pressure at 7 may be, and often is, greater than the pressure at 5. The former pressure must therefore be screened from the surface 9 by means of a sealing element 15 while the pressure at 9 is simultaneously kept at a low level by connecting this volume to a vacuum or intermediate pressure through channel 16. A groove 17 is preferably formed in the surface 14 of cylinder or piston of valve 1 in order to connect the volume at 10 to channel 8 where, as mentioned earlier, a vacuum prevails. The surrounding cylindrical surfaces 11 and 13 are arranged to fit the corresponding different diameters of the lift valve 2.

FIG. 4 shows the lift valves in the unloaded position, the bores at 5 and 6, respectively, communicating with pressure levels lower than the pressure prevailing in the operating chamber at each lift valve position.

Figure 7:
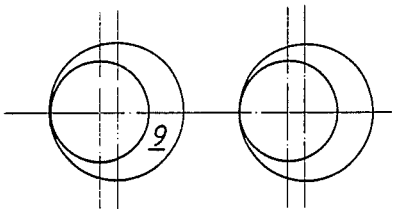
FIG. 7 shows, on a further enlarged scale, a detail of a rotary screw compressor which includes lift valves according to a third preferred embodiment of the present invention.
Figure 7:
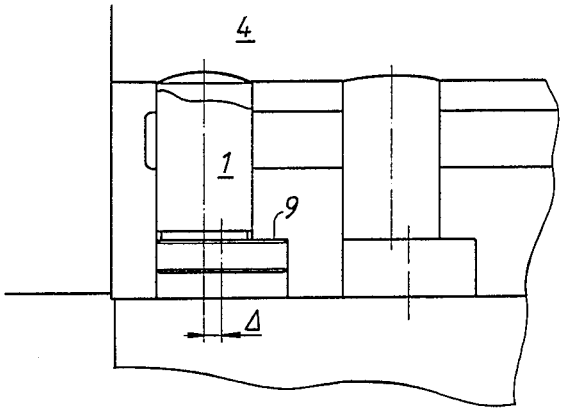

FIGS. 4 and 5 show the rotor bore as cylindrical and the lift valves with flat end surfaces. The volume remaining in the lift-valve cylinder towards the operating chamber is a "damaging" volume and may cause fully measurable losses, at least under some operating conditions. The end surface of the lift valve should therefore be shaped the same as the cylinder bore, as shown in FIG. 6. The lift valve must be provided with a guide to prevent it turning. This is achieved by locating the different diameters of the lift valve 2 eccentrically in relation to each other as shown in FIG. 7

What is claimed is:

1. A lift valve for use in a valve bore of a rotary screw compressor which includes a compressor chamber; an outlet channel; a valve bore which extends between said compressor chamber and said outlet channel, said valve bore having two cylindrical portions of different diameters, the portion with the smaller diameter communicating with said compressor chamber and the portion with the larger diameter communicating with said outlet channel; and a vacuum channel which communicates with the smaller diameter portion of said valve bore; said lift valve comprising a cylindrical first part defining a first end and a second end and a cylindrical second part that extends away from the second end of said cylindrical first part, said cylindrical second part having a smaller diameter than said cylindrical first part and being positioned with respect to said cylindrical first part such that an axis therethrough is parallel with yet offset from an axis through said cylindrical first part, such that the second end of said cylindrical first part has an exposed annular surface portion, said cylindrical second part including an axial groove in the surface thereof that extends along a portion of its length and communicates with said annular surface portion at the second end of said cylindrical part.

2. A lift valve according to claim 1, wherein said cylindrical second part provides an end surface remote from said cylindrical first part which is flat.

3. A lift valve according to claim 1, wherein said cylindrical second part provides an end surface remote from said cylindrical first part which is concave.

4. A rotary screw compressor which includes means forming compressor chamber; means forming an outlet channel; means forming two valve bores which extend between said compressor chamber and said outlet channel, each valve bore having two cylindrical portions of different diameters, the portion with the smaller diameter communicating with said compressor chamber and the portion with the larger diameter communicating with said outlet channel, said first and second portions being located relative to one another such that an axis through said first portion is parallel with yet offset from an axis through said second portion; means forming a vacuum channel which communicates with the smaller diameter portion of said valve bore; and a lift valve which is movably positioned in each said valve bore, each said lift valve comprising a cylindrical first part defining a first end and a second end and a cylindrical second part that extends away from the second end of said cylindrical first part, said cylindrical second part having a smaller diameter than said cylindrical first part and being positioned with respect to said cylindrical first part such that an axis therethrough is parallel with yet offset from an axis thrcugh said cylindrical first part, such that the second end of said cylindrical first part has an exposed annular surface portion, said cylindrical second part including an axial groove in the surface thereof that extends along a portion of its length and communicates with said annular surface portion at the second end of said cylindrical first part.

5. A rotary screw compressor according to claim 1, wherein said cylindrical second part of each of said lift valves provides an end surface remote from said cylindrical first part which is flat.

6. A rotary screw compressor according to claim 1, wherein said cylindrical second part of each of said lift valves provides an end surface remote from said cylindrical first part which is concave.

* * * * *